United States Patent [19]

Arbor

[11] Patent Number: 5,039,108

[45] Date of Patent: Aug. 13, 1991

[54] FREE STYLE PLAYING STICK

[76] Inventor: Arbor, P.O. Box 997, Santa Cruz, Calif. 95060

[21] Appl. No.: 532,440

[22] Filed: Jun. 4, 1990

[51] Int. Cl.[5] ..... A63B 67/00

[52] U.S. Cl. ..... 273/327; 273/428

[58] Field of Search ..... 273/327, 318, 428, 236

[56] References Cited

U.S. PATENT DOCUMENTS

| | | | |
|---|---|---|---|
| 2,364,137 | 12/1944 | Gibb | 273/428 |
| 2,377,498 | 6/1945 | Jacke | 273/428 |
| 3,008,264 | 11/1961 | Rutherford | 273/236 |
| 3,106,039 | 10/1963 | Simpson | 273/327 X |
| 3,443,809 | 5/1969 | Montanez | 273/428 X |
| 3,528,659 | 9/1970 | Benham | 273/428 X |
| 4,750,745 | 6/1988 | Benham | 273/327 |
| 4,796,883 | 1/1989 | Ratner | 273/318 X |
| 4,895,377 | 1/1990 | Arbor | 273/327 |

*Primary Examiner*—William H. Grieb

*Attorney, Agent, or Firm*—Limbach, Limbach & Sutton

[57] ABSTRACT

A free style playing stick is kept in the air by striking or catching it with a secondary spinner stick or a player's hand, foot, knee and the like. For ease of play a pair of additional striking surfaces are provided at each end and a pair symmetrically about the center. The additional striking surfaces are of sufficient size to allow a rod to be stopped which is traveling along its axis. The additional striking surfaces about the center are discs which are spaced apart from one another a distance less than the width of an average person's foot. The stick may be blow molded.

6 Claims, 1 Drawing Sheet

FREE STYLE PLAYING STICK

FIELD OF THE INVENTION

This invention relates to a field of aero toys. More particularly, this invention relates to a juggling stick for play off a secondary spinner stick, the players hand, foot, knee, shoulder and the like.

BACKGROUND OF THE INVENTION

Juggling games of manual dexterity are known where a secondary hand-held stick is used to strike the juggling stick and keep it in the air. To promote the ease of play, various forms of additional striking surfaces have been utilized as described in U.S. Pat. Nos. 3,106,039, 3,528,659, 3,433,809, 3,008,264, 2,377,498, 2,364,137, 4,750,745, 4,796,883 and 4,895,377. Of all the prior juggling sticks, those disclosed by this inventor in U.S. Pat. No. 4,895,377 having the outwardly facing cones at the center of the stick are by far the easiest to keep active during play. The inventor's previous U.S. Pat. No. 4,895,377 is incorporated herein by reference. Because the cones are hollow and open-ended to keep the weight of the stick low, such juggling sticks are difficult and expensive to manufacture. Expensive or complicated manufacturing techniques are required to produce such a stick.

The juggling stick 10, accordingly to 4,895,377, includes a central rod 12, a cone 14 at each end of the rod oriented to have the access of the cone 14 coincident with the access of the rod 12 with the larger ends of the cone toward the middle. A pair of centrally located cones 16 are also oriented to have their axes coincident with the axes of the rod 12 and are oriented to have the larger end of each centrally located cone 16 closer to the ends of the rod 12.

A player striking juggling stick 10 in the attitude shown in FIG. 1 at striking surface 18 can catch the juggling stick 10 on a secondary handheld spinner stick. A player striking the outside surface 20 of the cone 16 with a secondary spinner stick might easily lose control of the juggling stick 10 and end play.

SUMMARY OF THE INVENTION

A free style playing stick is kept in the air by striking or catching it with a secondary spinner stick or a player's hand, foot, knee and the like. For ease of play a pair of additional striking surfaces are provided at each end and a pair symmetrically about the center. The additional striking surfaces are of sufficient size to allow a rod to be stopped which is traveling along its axis. The additional striking surfaces about the center are discs which are spaced apart from one another a distance less than the width of an average person's foot. The stick may be blow molded or soft, lightweight discs of rubber or plastic may be inserted and/or attached about the center or distal ends of hollow PVC or other plastic polymer tubing.

DETAILED DESCRIPTION OF THE PREFERRED EMBODIMENT

Figure 2:
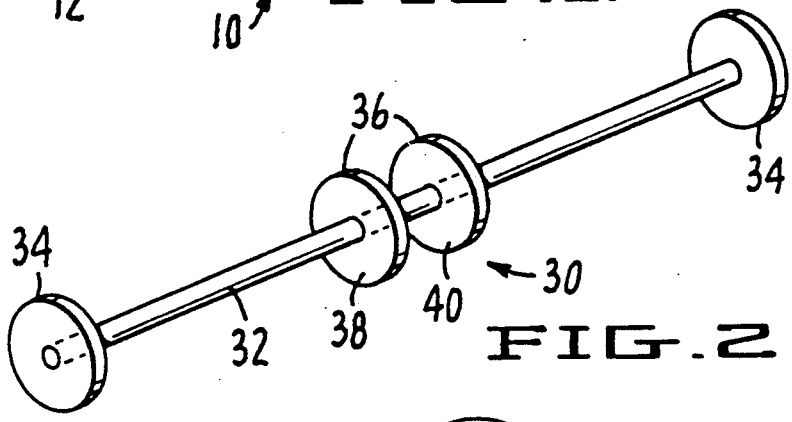
FIG. 2 shows a free style playing stick according to the preferred embodiment of the present invention.

FIG. 2 shows the preferred embodiment of the present invention. HAIKICHI STICKS is a trademark of the inventor, to identify his free style playing stick. The present invention is more than a traditional juggling stick which is kept in play by striking it with secondary spinner sticks. Rather, the free style playing sticks of the present invention can also be kept in play with a player's hand, foot, knee and the like. Thus, Haikichi Sticks provide the opportunity for aerobic exercise and/or sporting or competitive games which is simply not possible with traditional juggling sticks.

The free style playing stick 30 includes a central rod 32 having a disc or ferrule 34 at each distal end of the rod 32. A pair of discs 36 are symmetrically oriented about the center of the rod 32. The discs 34 and 36 have a sufficiently larger diameter than the rod 32 to allow a player to stop the rod with a secondary spinner stick as it travels along its axis. In other words, the radius of the discs 34 and 36 should be greater than the radius of the rod 32 by approximately the diameter of the secondary spinner.

Figure 1:
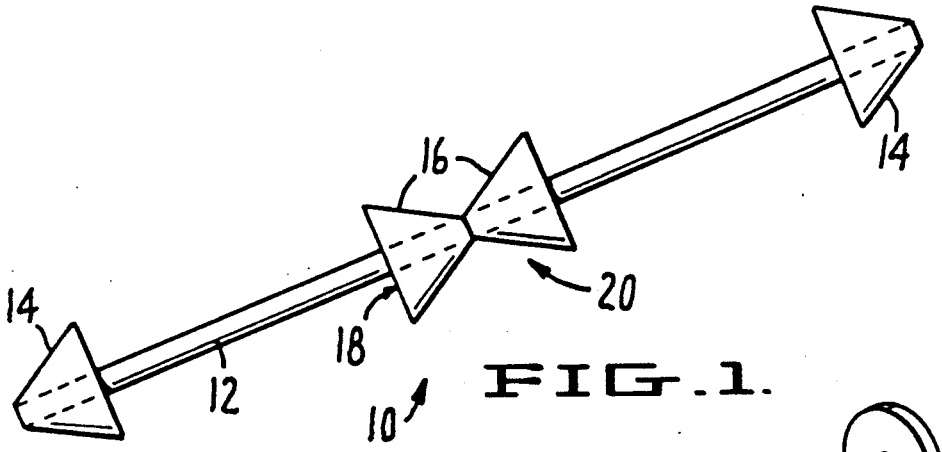
FIG. 1 shows a free style playing stick accordingly to U.S. Pat. No. 4,895,377.

A player can catch and control the free style playing stick with a secondary spinner at surface 38 which is analogous to surface 18 of FIG. 1. A player can also catch and control the spinner stick at surface 40. The striking surface 40 does not exist on the free style playing stick of FIG. 1.

Figure 3:
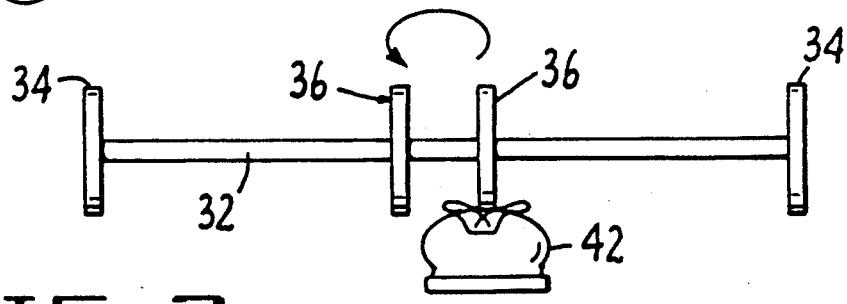
FIG. 3 shows how angular momentum is imparted to a free style playing stick of the present invention.

Another important feature of this invention is that a player may use their hand, foot, knee, elbow etc. in playing. If a player kicks only one of the centrally located discs 36 on a stick 30 with their foot or shoe 42 as shown in FIG. 3, an angular momentum will be imparted to the free style playing stick 30. This spinning rotation around the center of the stick 32 may be undesirable.

Figure 4:
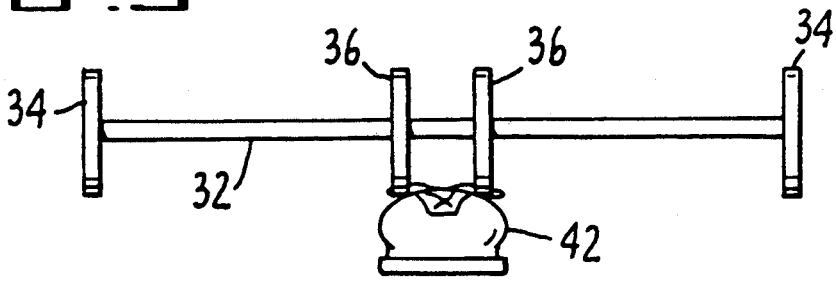
FIG. 4 shows how the present invention prevents angular momentum under certain circumstances.

In order to allow a player the ability to prevent or control this rotation of the free style playing stick 30, it is an important feature of the present invention that the two central discs 36 are positioned close enough to one another that they are less wide than the average player's foot as shown in FIG. 4. This way, when a player wishes to avoid spinning the free style playing stick they need merely kick both discs 36 at the same time with their foot or shoe 42. Also, due to the simplicity of the physical features of this free style playing stick, such a stick can be easily mass-produced using commonly known blow molding techniques. The distance between the central discs is on the order of 4 inches apart. Sticks with narrower gaps may be used for children.

Figure 5:
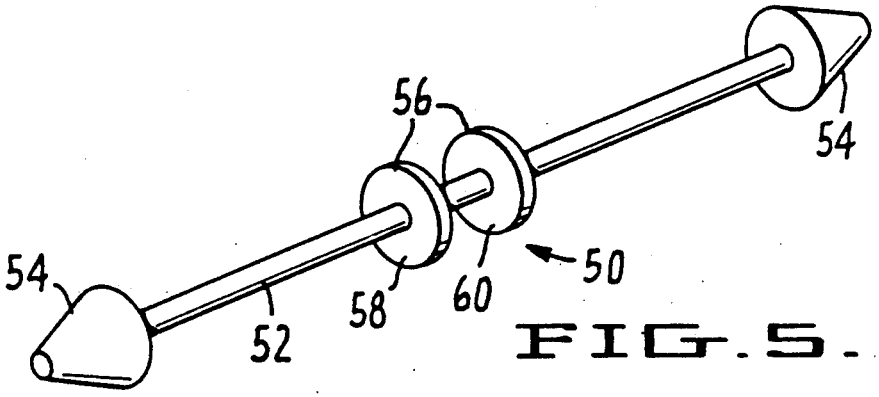
FIG. 5 shows an alternate embodiment of the present invention.

The free style playing stick of FIG. 5 shows an alternate embodiment of the present invention. The free style playing stick includes a central rod 52 and two cones 54 positioned at each end of the free style playing stick and oriented so that the larger ends of the cone are closer to the center of the rod. A pair of discs 56 are located symmetrically about the center of the rod and less far from one another than the width of the average persons foot.

What is claimed is:

1. A free style playing stick comprising:

a. a rod;

b. first additional striking surfaces positioned at each end of the rod of sufficient size to stop the rod traveling along its axis;

c. a pair of discs located symmetrically about a center of the rod and spaced apart from one another a distance less than the width of an average persons foot and extending beyond the surface of the rod of sufficient size to stop the rod traveling along its axis.

2. The free style playing stick according to claim 1 further comprising a secondary spinner for striking and catching the free style playing stick.

3. The free style playing stick according to claim 1 wherein each of the first additional striking surfaces is a first ferrule having a first larger end, a first smaller end oriented so that the smaller end is closer to the end of the rod than the larger end.

4. The free style playing stick according to claim 1 wherein each of the first additional striking surfaces are discs.

5. The free style playing stick according to claim 1 wherein the free style playing stick may be formed by a typical molding process.

6. The free style playing stick according to claim 1 wherein the pair of discs are less than or equal to four inches apart.

* * * * *

UNITED STATES PATENT AND TRADEMARK OFFICE

CERTIFICATE OF CORRECTION

PATENT NO. : 5,039,108

DATED : August 13, 1991

INVENTOR(S) : ARBOR

It is certified that error appears in the above - identified patent and that said Letters Patent is hereby corrected as shown below:

In Col. 1, line 17, delete "3,433,809" and replace with --3,443,809--.

Signed and Sealed this

Eighth Day of December, 1992

*Attest:*

DOUGLAS B. COMER

*Attesting Officer*

*Acting Commissioner of Patents and Trademarks*